US010324403B2

(12) United States Patent
Tamura

(10) Patent No.: US 10,324,403 B2
(45) Date of Patent: Jun. 18, 2019

(54) IMAGE FORMING APPARATUS CONTAINING FIXING MEMBER, BLOWING SECTION, AND HARDWARE PROCESSOR

(71) Applicant: Konica Minolta, Inc., Tokyo (JP)

(72) Inventor: Nobuyasu Tamura, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/902,568

(22) Filed: Feb. 22, 2018

(65) Prior Publication Data

US 2018/0253042 A1 Sep. 6, 2018

(30) Foreign Application Priority Data

Mar. 2, 2017 (JP) ..... 2017-039521

(51) Int. Cl.

| | |
|---|---|
| ***G03G 15/20*** | (2006.01) |
| ***G03G 15/16*** | (2006.01) |
| ***G03G 21/20*** | (2006.01) |
| *G03G 15/00* | (2006.01) |

(52) U.S. Cl.

CPC ..... *G03G 15/2028* (2013.01); *G03G 15/1675* (2013.01); *G03G 15/2053* (2013.01); *G03G 15/2064* (2013.01); *G03G 21/206* (2013.01); *G03G 15/6573* (2013.01)

(58) Field of Classification Search

CPC ..... G03G 15/2028; G03G 21/206; G03G 15/1675; G03G 15/2053; G03G 15/2064; G03G 15/2085; G03G 15/6532; G03G 2215/00573; G03G 21/0052; G03G 15/6573; G03G 2215/00417

See application file for complete search history.

(56) References Cited

U.S. PATENT DOCUMENTS

| | | | | |
|---|---|---|---|---|
| 2011/0305492 | A1* | 12/2011 | Tamaki | G03G 15/2028 399/323 |
| 2012/0027476 | A1* | 2/2012 | Tanaka | G03G 15/2028 399/323 |
| 2013/0078015 | A1* | 3/2013 | Maruko | G03G 15/2028 399/323 |
| 2016/0026140 | A1* | 1/2016 | Oomoto | G03G 15/2028 399/323 |

FOREIGN PATENT DOCUMENTS

| | | | |
|---|---|---|---|
| JP | 2012234067 | A | 11/2012 |

* cited by examiner

*Primary Examiner* — David M. Gray
*Assistant Examiner* — Laura Roth
(74) *Attorney, Agent, or Firm* — Lucas & Mercanti, LLP

(57) ABSTRACT

An image forming apparatus includes a fixing member, a blowing section, and a hard ware processor. The blowing section generates airflow toward the fixing nip, and the airflow is used for separating a sheet from the fixing member. The hardware processor performs a control of the blowing section so that airflow amounts of the blowing section toward the fixing nip are different in an axial direction of the fixing member and part of the airflow flowing from the blowing section toward a non-sheet-passing region of the fixing nip is directed in the moving direction of the fixing member.

8 Claims, 8 Drawing Sheets

IMAGE FORMING APPARATUS CONTAINING FIXING MEMBER, BLOWING SECTION, AND HARDWARE PROCESSOR

CROSS REFERENCE TO RELATED APPLICATIONS

The entire disclosure of Japanese patent Application No. 2017-039521, filed on Mar. 2, 2017, is incorporated herein by reference in its entirety.

BACKGROUND

Technological Field

The present invention relates to an image forming apparatus.

Description of Related Art

In general, an electrophotographic image forming apparatus (such as a printer, a copier, or a fax machine) is configured to irradiate (expose) a charged photoconductor drum (image bearing member) with (to) laser light based on image data to form an electrostatic latent image on the surface of the photoconductor. The electrostatic latent image is then visualized by supplying toner from a developing device to the photoconductor drum on which the electrostatic latent image is formed, whereby a toner image is formed. Further, the toner image is directly or indirectly transferred to a sheet, and then heat and pressure are applied to the sheet at a fixing nip to form a toner image on the sheet.

In the meantime, in a non-sheet-passing region of the fixing nip within which no sheet is passed through, there is no possibility that a sheet passing through the fixing nip takes away heat, so that a problem arises in that the temperature in the non-sheet-passing region in a fixing section rises. This problem arises when sheets of a size smaller than that of a sheet having the maximum width allowing the sheet to pass through in the fixing section are passed through consecutively one by one.

For example, Japanese Patent Application Laid-Open No. 2012-234067 discloses a configuration in which a cooling fan is provided in order to solve this problem. In this configuration, a non-sheet-passing portion of a fixing section is cooled with the cooling fan depending on a sheet size.

SUMMARY

However, in the case of a configuration in which a fixing section is provided with a separating section for generating airflow for separating a sheet from a fixing member, there has been a problem in that an image forming apparatus is made oversize when a cooling fan for cooling a non-sheet-passing region in the fixing section is provided in the fixing section in addition to the separating section.

An object of the present invention is to provide an image forming apparatus in which a temperature rise in the non-sheet-passing region in the fixing section can be prevented without the image forming apparatus being made oversize in a configuration in which the image forming apparatus is provided with a separating section.

An image forming apparatus in which one aspect of the present invention is reflected in an attempt to at least partly achieve the above-mentioned object includes: a rotatable fixer that forms a fixing nip between the rotatable fixer and a pressurizer; a blower configured to generate airflow toward the fixing nip, the airflow being for separating a sheet from the rotatable fixer; and a hardware processor configured to perform a control of causing airflow amounts of the blower to be different in an axial direction of the rotatable fixer so that part of the airflow flowing from the blower toward a non-sheet-passing region of the fixing nip is directed toward the rotatable fixer.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
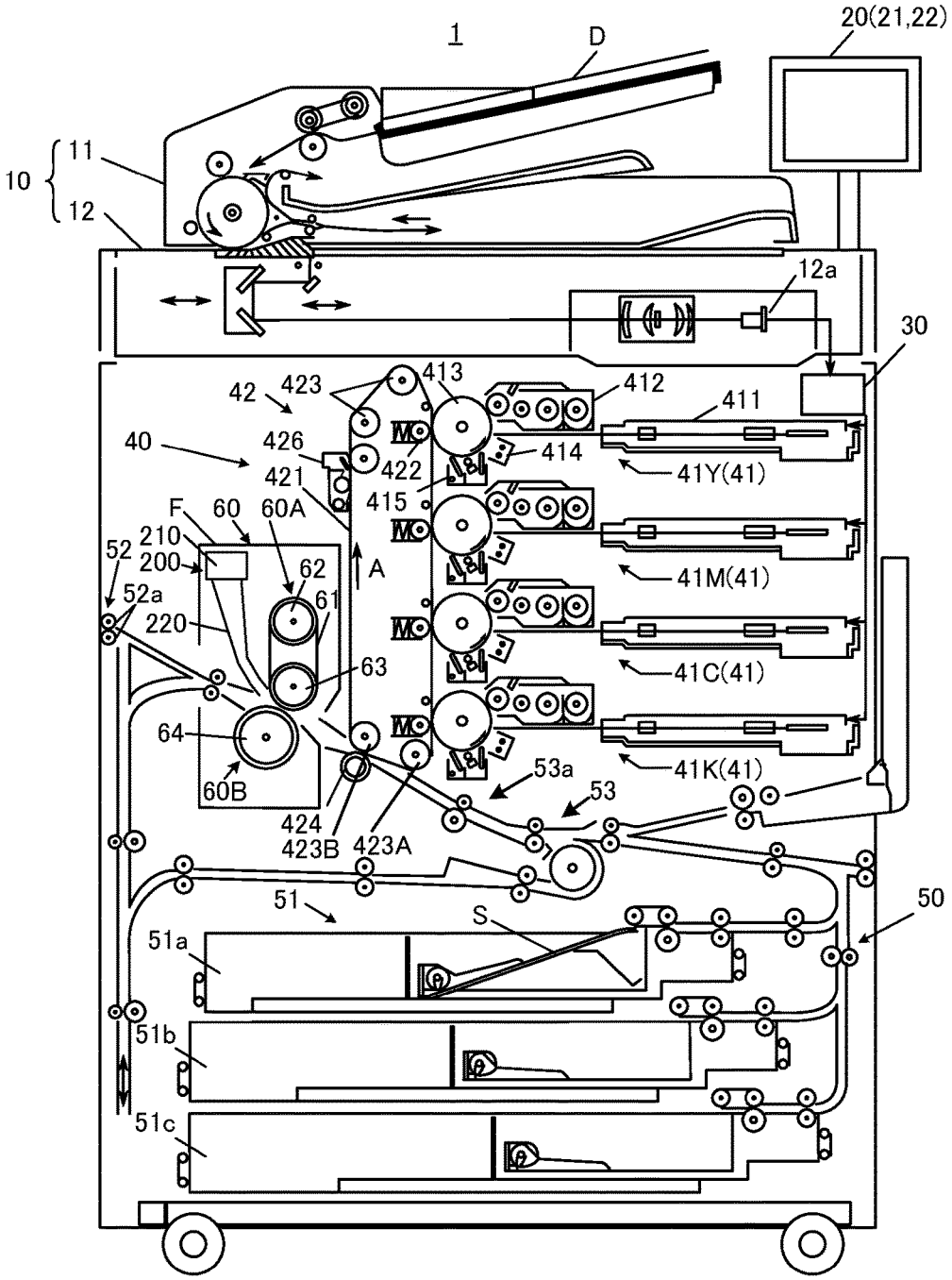
FIG. 1 schematically illustrates an entire configuration of an image forming apparatus according to an embodiment of the present invention.
Figure 2:
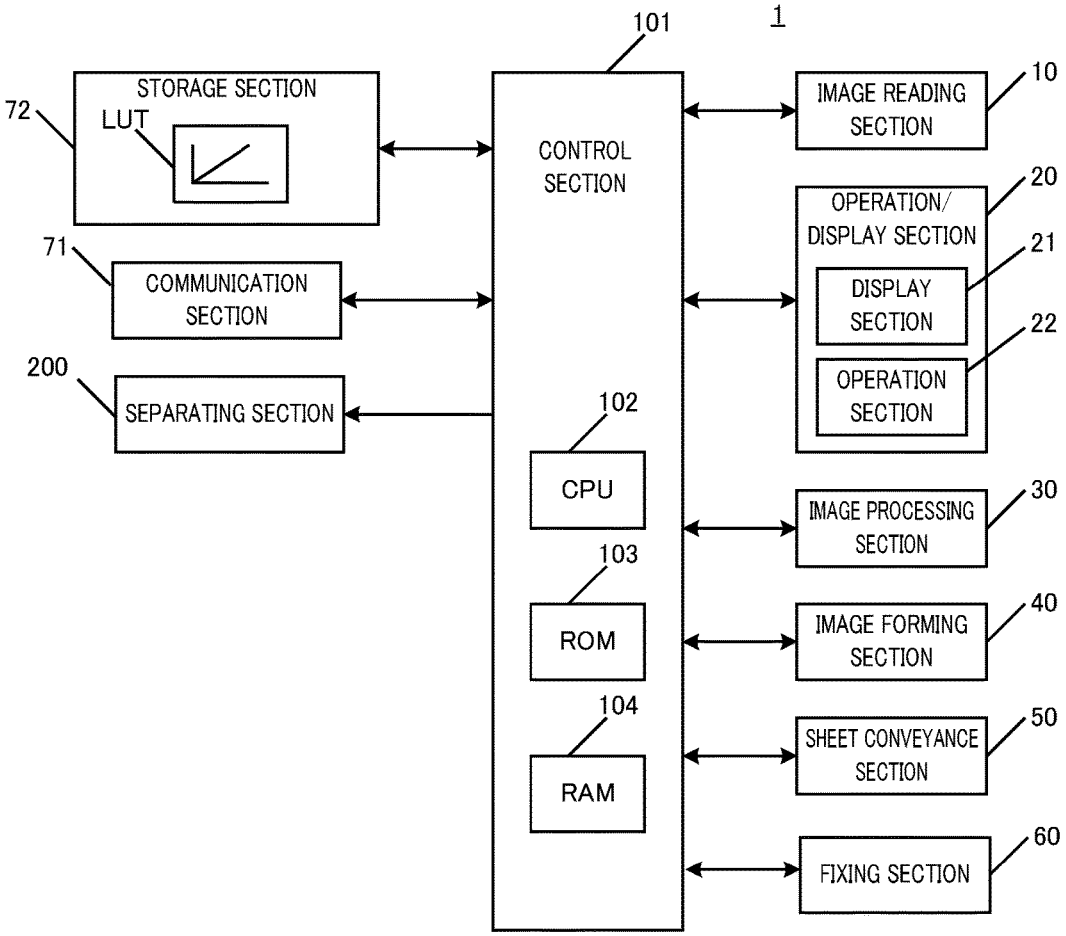
FIG. 2 illustrates a principal part of a control system of the image forming apparatus according to the embodiment of the present invention.

Hereinafter, an embodiment of the invention is described in detail based on the drawings. FIG. 1 schematically illustrates an entire configuration of image forming apparatus 1 according to the embodiment of the present invention. FIG. 2 illustrates a principal part of a control system of image forming apparatus 1 according to the embodiment of the present invention.

Image forming apparatus 1 illustrated in FIG. 1 is a color image forming apparatus of an intermediate transfer system using electrophotographic process technology. That is, image forming apparatus 1 transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 secondary-transfers the resultant image to sheet S sent out from feeding tray units 51*a* to 51*c*, thereby forming an image.

A longitudinal tandem system is adopted for image forming apparatus 1. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

As illustrated in FIG. 2, image forming apparatus 1 includes image reading section 10, operation/display section 20, image processing section 30, image forming section 40, sheet conveyance section 50, fixing section 60, and control section 101.

Control section 101 includes central processing unit (CPU) 102, read only memory (ROM) 103, random access memory (RAM) 104 and the like. CPU 102 reads a program suited to processing contents out of ROM 103, loads the program into RAM 104, and integrally controls an operation of each block of image forming apparatus 1 in cooperation with the loaded program. At this time, CPU 101 refers to various kinds of data stored in storage section 72. Storage section 72 is composed of, for example, a non-volatile semiconductor memory (so-called flash memory) or a hard disk drive.

Control section 101 transmits and receives various data to and from an external apparatus (for example, a personal computer) connected to a communication network such as a local area network (LAN) or a wide area network (WAN), through communication section 71. Control section 101 receives, for example, image data (input image data) transmitted from the external apparatus, and performs control to form an image on sheet S on the basis of the image data. Communication section 71 is composed of, for example, a communication control card such as a LAN card.

As illustrated in FIG. 1, image reading section 10 includes auto document feeder (ADF) 11, document image scanning device 12 (scanner), and the like.

Auto document feeder 11 conveys, with a conveyance mechanism, document D placed on a document tray, to send out document D to document image scanner 12. Auto document feeder 11 makes it possible to successively read at once images (even both sides thereof) of a large number of documents D placed on the document tray.

Document image scanner 12 optically scans a document conveyed from auto document feeder 11 onto a contact glass or a document placed on the contact glass, and images reflected light from the document on a light receiving surface of charge coupled device (CCD) sensor 12*a* to read the document image. Image reading section 10 generates input image data based on results read by document image scanner 12. The input image data undergo predetermined image processing in image processing section 30.

As illustrated in FIG. 2, operation/display section 20 includes, for example, a liquid crystal display (LCD) provided with a touch panel, and functions as display section 21 and operation section 22. Display section 21 displays various operation screens, image conditions, operating statuses of each function, and/or the like in accordance with display control signals input from control section 101. Operation section 22 equipped with various operation keys, such as a numeric keypad and a start key, receives various input operations by users and outputs operation signals to control section 101.

Image processing section 30 includes a circuit and/or the like that performs digital image processing of input image data in accordance with default settings or user settings. For example, image processing section 30 performs tone correction based on tone correction data (tone correction table) under the control of control section 101. Moreover, image processing section 30 performs various correction processing, such as color correction or shading correction, in addition to tone correction, and, compression processing, and the like of input image data. Image forming section 40 is controlled on the basis of the image data that has been subjected to these processes.

As illustrated in FIG. 1, image forming section 40 includes: image forming units 41Y, 41M, 41C, and 41K that form images of colored toners of a Y component, an M component, a C component, and a K component on the basis of the input image data; intermediate transfer unit 42; and the like.

Image forming units 41Y, 41M, 41C, and 41K for the Y component, the M component, the C component, and the K component have similar configurations. For convenience in illustration and description, common elements are denoted by the same reference signs and such reference signs are accompanied by Y, M, C, or K when they are to be distinguished. In FIG. 1, reference signs are given to only the elements of image forming unit 41Y for the Y component, and reference signs are omitted for the elements of other image forming units 41M, 41C, and 41K.

Image forming unit 41 includes exposing device 411, developing device 412, photoconductor drum 413, charging device 414, drum cleaning device 415 and the like.

Photoconductor drum 413 is an organic photoconductor including, for example, a drum-shaped metallic base including the outer peripheral surface on which a photosensitive layer made of a resin containing an organic photoconductive material is formed.

Control section 101 causes photoconductor drum 413 to rotate at a constant peripheral velocity by control of a driving current supplied to a driving motor (not illustrated) that causes photoconductor drum 413 to rotate.

Charging device 414 is an electrostatic charger, for example, and evenly and negatively charges the surface of photoconductor drum 413 having photoconductivity by generating corona discharge.

Exposing device 411 is composed of, for example, a semiconductor laser, and configured to irradiate photoconductor drum 413 with laser light corresponding to the image of each color component. As a result, electrostatic latent images of respective color components are formed in an imaging area irradiated with laser light on the surface of photoconductor drum 413 because of potential differences from a background region.

Developing device 412 is a developing device of a two-component counter-rotation type, and attaches developing agents of respective color components to the surface of photoconductor drums 413, and visualizes the electrostatic latent image to form a toner image.

A direct-current developing bias of the polarity identical to the charge polarity of charging device 414, or a developing bias in which a direct current voltage of the polarity identical to the charge polarity of charging device 414 is superposed on an alternating current voltage is applied to developing device 412, for example. As a result, reversal development in which toner adheres to the electrostatic latent image formed by exposing device 411 is effected.

Drum cleaning device 415 includes a platelike drum cleaning blade made of an elastic body and is brought into contact with the surface of photoconductor drum 413, and removes transfer residual toner that remains on the surface of photoconductor drum 413 without transferred to intermediate transfer belt 421.

Intermediate transfer unit 42 includes intermediate transfer belt 421, primary transfer roller 422, a plurality of support rollers 423, secondary transfer roller 424, belt cleaning device 426, and the like.

Intermediate transfer belt 421 is composed of an endless belt, and is wound under tension around the plurality of support rollers 423 under in a loop form. At least one of the plurality of support rollers 423 is composed of a driving roller, and the others are each composed of a driven roller. For example, it is preferable that roller 423A disposed on the downstream side in the belt travelling direction relative to primary transfer roller 422 for the K component be a driving roller. This makes it easier to keep constant the travelling speed of the belt in a primary transfer part. Intermediate transfer belt 421 travels in direction of arrow A at a constant speed by rotation of a driving roller 423A.

Intermediate transfer belt 421 is a conductive and elastic belt and includes at its surface a high-resistance layer. Intermediate transfer belt 421 is driven into rotation with the control signal from control section 101.

Primary transfer rollers 422 are disposed on the inner peripheral surface side of intermediate transfer belt 421 to face photoconductor drums 413 of respective color components. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face backup roller 423B disposed on the downstream side in the belt travelling direction relative to driving roller 423A, at a position on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to sheet S is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and an electric charge of the polarity opposite to the polarity of the toner is applied to the rear surface side, that is, a side of intermediate transfer belt 421 that makes contact with primary transfer rollers 422 whereby the toner image is electrostatically transferred to intermediate transfer belt 421.

Thereafter, when sheet S passes through the secondary transfer nip, the toner image on intermediate transfer belt 421 is secondary-transferred to sheet S. To be more specific, a secondary transfer bias is applied to secondary transfer roller 424, and an electric charge of the polarity opposite to the polarity of the toner is applied to the rear surface side of sheet S, that is, a side of sheet S that makes contact with secondary transfer roller 424 whereby the toner image is electrostatically transferred to sheet S. Sheet S to which the toner image has been transferred is conveyed towards fixing section 60.

Belt cleaning device 426 removes transfer residual toner which remains on the surface of intermediate transfer belt 421 after a secondary transfer.

Fixing section 60 includes upper fixing section 60A having a fixing-surface-side member disposed on a fixing surface side of sheet S, that is, on a side of the surface of sheet S on which a toner image is formed, lower fixing section 60B having a rear-surface-side supporting member disposed on the rear surface side of sheet S, that is, on a side of the surface of sheet S opposite to the fixing surface, a heating source, and the like. The rear-surface-side supporting member is brought into pressure contact with the fixing-surface-side member, whereby a fixing nip for conveying sheet S in a tightly sandwiching manner is formed.

At the fixing nip, toner-image fixer 60 applies heat and pressure to sheet S on which a toner image has been secondary-transferred and which has been conveyed to the fixing nip, so as to fix the toner image on sheet S. Fixing section 60 is disposed as a unit in fixing device F.

Upper fixing section 60A includes endless fixing belt 61, heating roller 62 and fixing roller 63, which serve as the fixing-surface-side member. Fixing belt 61 is wound around heating roller 62 and fixing roller 63 under tension. Fixing belt 61 corresponds to a "fixer" of the present invention.

Lower fixing section 60B includes pressurizing roller 64 that is the rear-surface-side supporting member. Together with fixing belt 61, pressurizing roller 64 forms a fixing nip for conveying sheet S in a tightly sandwiching manner. Pressurizing roller 64 corresponds to a "pressurizer" of the present invention.

In addition, separating section 200 having a function of separating sheet S from fixing belt 61 is provided in fixing section 60 on the downstream side. Separating section 200 includes blowing section 210 and duct portion 220.

Blowing section 210 is a fan configured to generate airflow for separating sheet S from fixing belt 61. Duct portion 220 is a duct for directing, toward the fixing nip, the airflow generated by blowing section 210.

Sheet conveyance section 50 includes sheet feeder 51, sheet ejection section 52, conveyance path section 53 and the like. Three sheet feeding tray units 51*a* to 51*c*, which constitute sheet feeding section 51, store sheets S classified based on basis weight, size, or the like (standard paper, special paper) in accordance with predetermined types. Conveying path section 53 includes a plurality of conveying roller pairs including registration roller pairs 53*a*. The registration roller section in which registration roller pairs 53*a* are provided corrects skew and deviation of sheet S.

Sheets S stored in sheet feeding tray units 51*a* to 51*c* are sent out one by one from the top one and conveyed to image forming section 40 through conveying path section 53. In image forming section 40, the toner image on intermediate transfer belt 421 is secondary-transferred to one side of sheet S at one time, and a fixing process is performed in fixing section 60. Sheet S on which an image has been formed is ejected out of the image forming apparatus by sheet ejection section 52 including sheet ejection rollers 52*a*.

Figure 3:
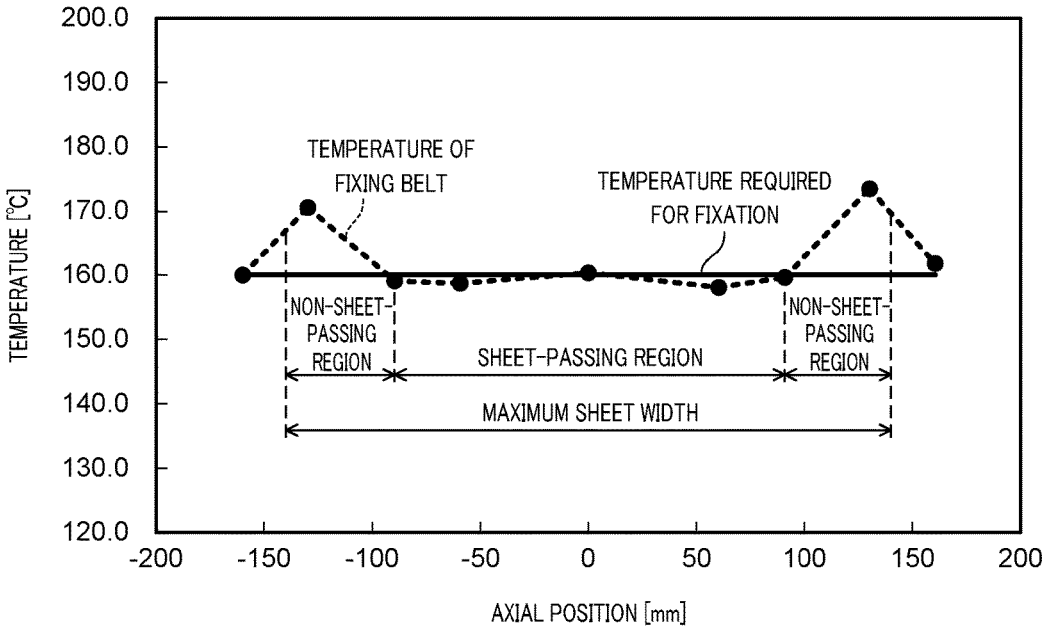
FIG. 3 indicates temperatures at positions in the axial direction of a fixing belt heated again after a sheet of a size smaller than the maximum sheet-passing width passed through a fixing nip.

In the meantime, in a non-sheet-passing region of the fixing nip within which sheet S is not passed through, there is no possibility that sheet S passing through the fixing nip takes away heat, so that a problem arises in that the temperature in the non-sheet-passing region in fixing section 60 rises to a temperature higher than required for fixation, as illustrated in FIG. 3. This problem arises when sheets S of a size smaller than that of sheet S having the maximum width allowing sheet S to pass through fixing section 60 are passed through consecutively one by one. An axial position along the abscissa in FIG. 3, in which the central portion of fixing belt 61 is expressed by 0, indicates a position shift amount with respect to the central portion.

FIG. 3 illustrates a state in which the temperature in the non-sheet-passing region rises when sheet S of a smaller size (for example, A4S having a sheet-passing width of 210 mm)

than the maximum sheet width passes through the fixing nip. In addition, FIG. 3 indicates the fall in temperature on the outside of the non-sheet-passing region. This fall is because less heat is distributed to the end portion of heat source in heating roller 62 inside fixing belt 61.

Such a temperature rise in the non-sheet-passing region of fixing belt 61 to a temperature higher than required for fixation may cause deterioration of members in fixing section 60.

Accordingly, in the embodiment of the present invention, control section 101 controls to cause airflow amounts of blowing section 210 to be different in the axial direction of fixing belt 61 so that part of the airflow flowing from blowing section 210 toward the non-sheet-passing region of the fixing nip is directed toward fixing belt 61. Specifically, control section 101 is configured to change, in a range of the non-sheet-passing region at fixing belt 61, the direction of airflow flowing from duct portion 220 such that the airflow is directed toward fixing belt 61, when sheet S of a size smaller than the maximum sheet width for fixing section 60 passes through the fixing nip.

This makes it possible to prevent an excessive rise in temperature of fixing belt 61 in the non-sheet-passing region. Hereinafter, the detailed configuration of duct portion 220 and the control of duct portion 220 according to the embodiment are described.

Figure 4:
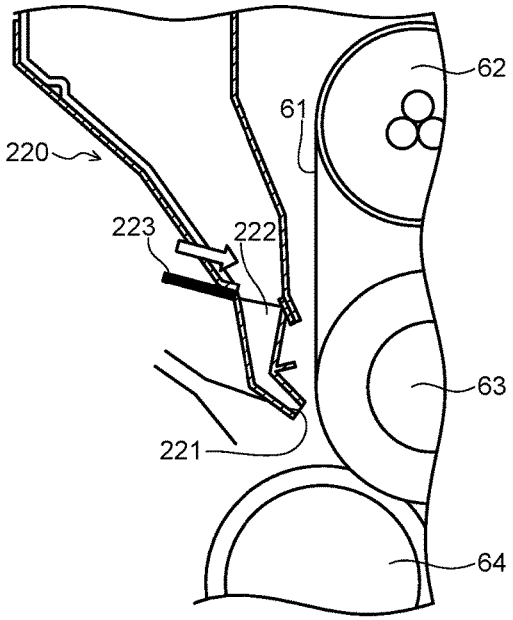
FIG. 4 is an enlarged view of a region around a duct portion.
Figure 5:
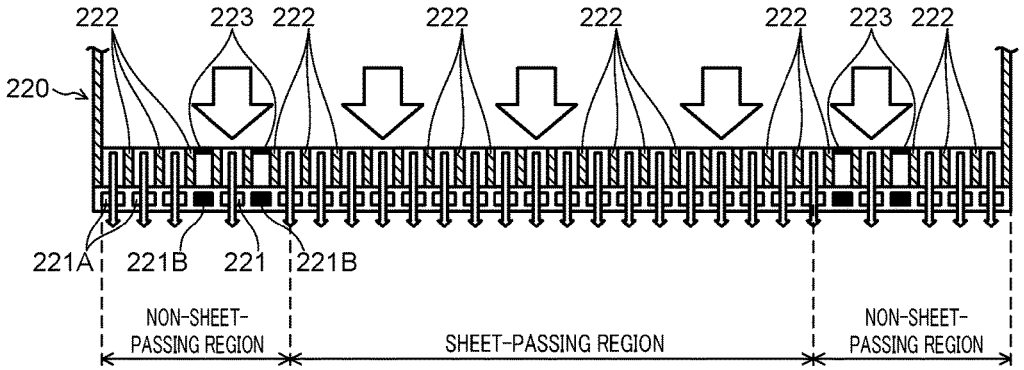
FIG. 5 is a sectional view of a tip end of the duct portion.

As illustrated in FIGS. 4 and 5, a plurality of openings 221 for directing the airflow from blowing section 210 toward the fixing nip are formed in the tip end of duct portion 220. In addition, duct portion 220 is provided with a plurality of ribs 222 and opening and closing members 223.

The plurality of openings 221 are provided in duct portion 220 in such a manner as to be aligned in the width direction (left-right direction in FIG. 5) of sheet S. The plurality of openings 221 are formed such that all intervals between two adjacent openings 221 are equal to each other.

The plurality of ribs 222 are disposed at positions corresponding to both edges of openings 221 in the width direction. Two ribs 222 disposed at positions of both edges of each opening 221 define an airflow path for the airflow to flow out of openings 221.

Opening and closing members 223 are each formed to have a width substantially the same as that of the airflow path defined by two ribs 222, and are each configured to be able to open and close the airflow path. In FIG. 4, opening and closing member 223 is disposed at a position for opening the airflow path. Note that, opening and closing members 223 move with a well-known moving mechanism.

When opening and closing member 223 moves in the direction indicated by the arrow, the airflow path is closed. This closure causes the airflow (indicated by the arrows) flowing toward openings 221 not to enter the airflow path as illustrated in FIG. 5, so that the airflow does not flow out of some of openings 221 closed by opening and closing members 223.

Further, control section 101 controls opening and closing members 223 so that first opening 221A through which airflow flows out and second opening 221B through which airflow does not flow out are alternately aligned. First opening 221A corresponds to an "airflow opening" of the present invention.

Figure 6:
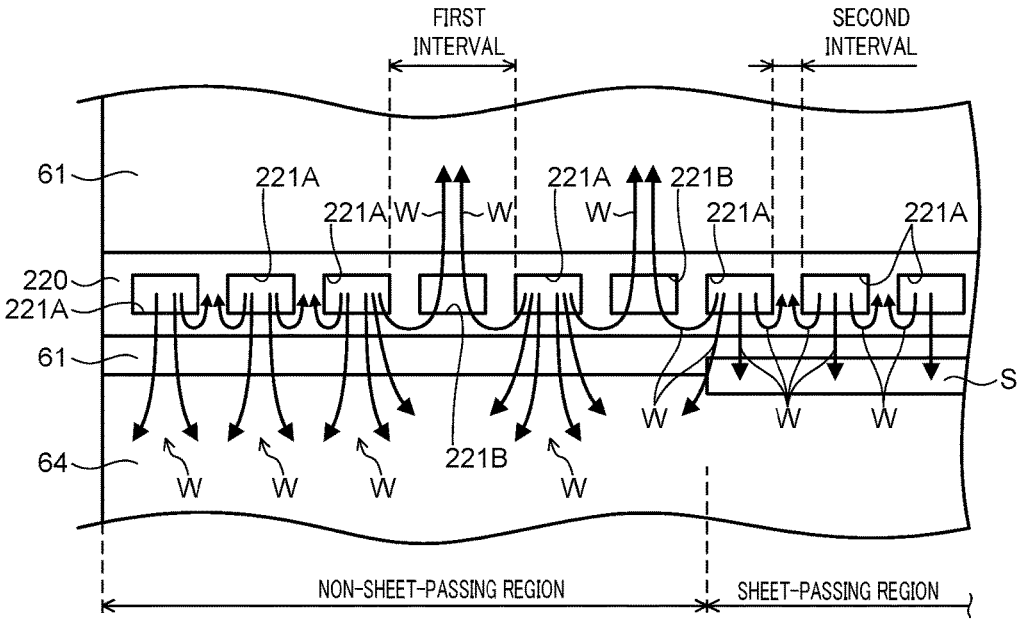
FIG. 6 is an explanatory view of the direction of airflow flowing out of the duct portion.

By this control, a first interval is made larger than a second interval as illustrated in FIG. 6, the first interval being defined between two first openings 221A with second opening 221B therebetween in the non-sheet-passing region, the second interval being defined between two first openings 221A in the sheet-passing region.

In other words, control section 101 is configured to make the first interval larger than the second interval, the first interval being defined between first openings 221A adjacent to each other in the non-sheet-passing region, the second interval being defined between first openings 221A adjacent to each other in the sheet-passing region. This causes airflow W in the first interval to flow upward in the figure, that is, toward fixing belt 61.

Specifically, airflow W flowing out of first opening 221A flows while spreading from first opening 221A. No airflow W flows out between two first openings 221A, so that the pressure loss is smaller in this region than in a region downward with respect to first openings 221A.

Thus, when streams of airflow W flowing out of two first openings 221A impinge on each other, both of the impinged streams of airflow W turn back on the side in which the pressure loss is smaller, so that a phenomenon in which streams of airflow W are directed upward occurs.

Figure 7:
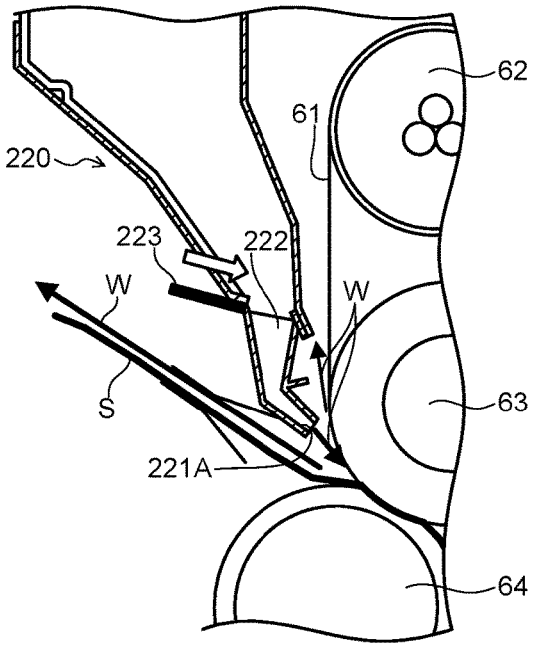
FIG. 7 is an explanatory view of the direction of the airflow in a sheet-passing region.

In the meanwhile, in the sheet-passing region, intervals between first openings 221A are the second interval, so that a space into which streams of airflow flowing out of first openings 221A turn back is narrow as illustrated in FIG. 6. Accordingly, as illustrated in FIG. 7, a large amount of airflow W flows between sheet S and fixing belt 61 at the fixing nip and this airflow W flows along with sheet S, whereas only a very small amount of airflow W flows toward the fixing belt 61. Therefore, in a case of a configuration in which the same amount of airflow W flows in the non-sheet-passing region as in the sheet-passing region, there is a risk that the temperature of the end of fixing belt 61 rises excessively.

Figure 8:
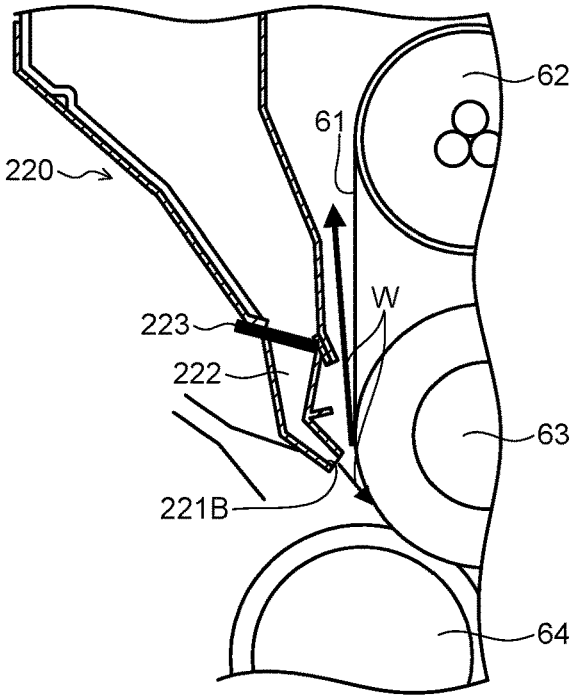
FIG. 8 is an explanatory view of the direction of the airflow in a part corresponding to a first interval in a non-sheet-passing region.

In the embodiment of the present invention, as illustrated in FIGS. 6 and 8, an interval between two first openings 221A is the first interval in the non-sheet-passing region, so that a larger space into which airflow W flowing out of first openings 221A turns back is secured in contrast to the sheet-passing region. Accordingly, a large amount of airflow W turns back upward, so that that the non-sheet-passing region of fixing belt 61 can be cooled effectively, and it is thus possible to prevent an excessive temperature rise in the non-sheet-passing region of fixing belt 61.

Figure 9:
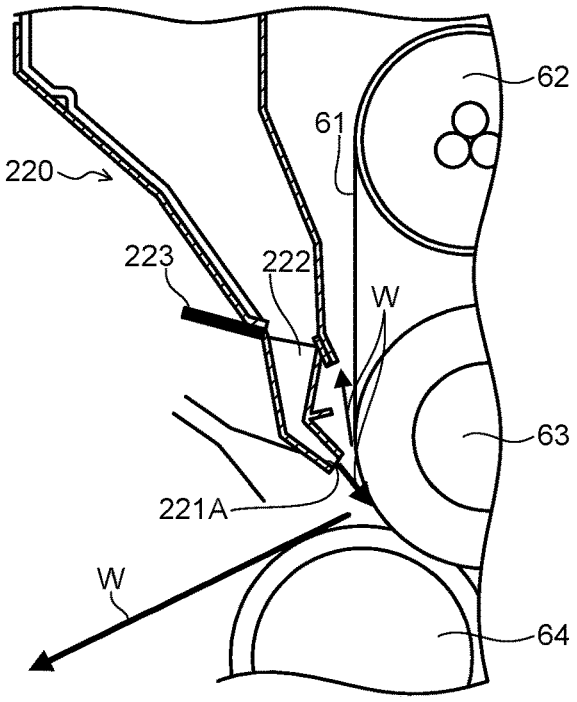
FIG. 9 is an explanatory view of the direction of the airflow in an end region of the non-sheet-passing region.

In addition, in the embodiment of the present invention, three openings from the edge of duct portion 220 are first openings 221A even in the non-sheet-passing region as illustrated in FIG. 6, and are not closed by opening and closing members 223. As illustrated in FIG. 9, only a very small amount of airflow W flows toward fixing belt 61 in this region. The reason for this is that less heat is distributed to the end portion of heat source in heating roller 62 (see FIG. 3), and an excessive fall in temperature of the end of fixing belt 61 is caused when airflow W is directed more toward fixing belt 61.

Figure 10:
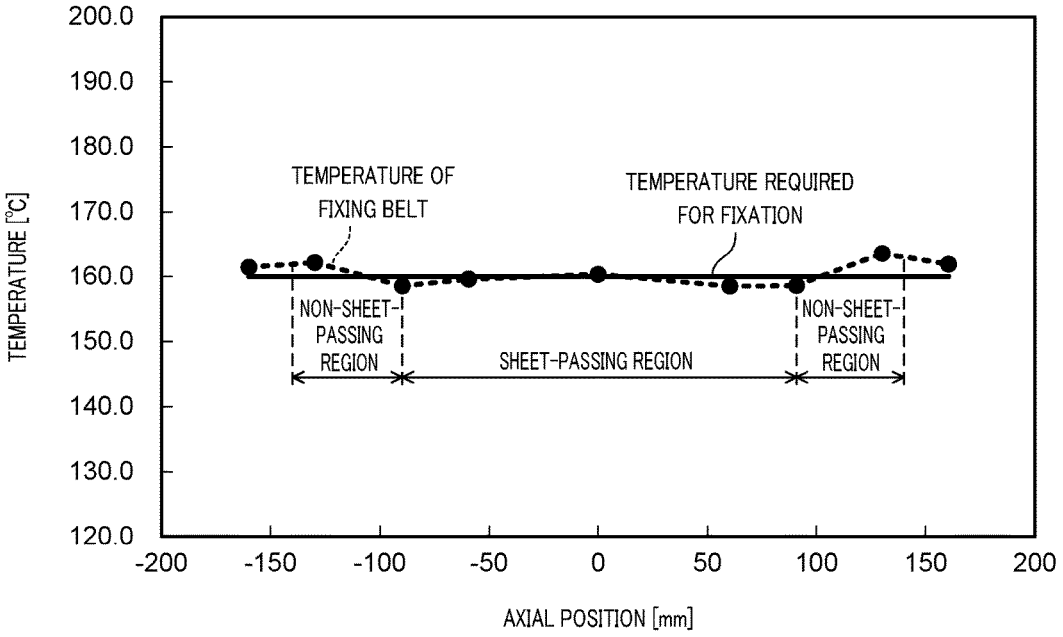
FIG. 10 illustrates temperatures at positions in the axial direction of the fixing belt of when the direction of airflow is changed.

This setting of openings as described above makes it possible to equalize all temperature states at positions in the axial direction of fixing belt 61 so as to achieve temperature states approximate to that required for fixation in the embodiment of the present invention, as illustrated in FIG. 10.

Moreover, there are portions corresponding to second openings 221B at two places in the non-sheet-passing region. It is desirable that a portion of fixing belt 61 having the maximum temperature be included in a range of portions corresponding to these two second openings 221B (i.e. in a range of portions corresponding to two first intervals) when sheet S passes through the fixing nip. In this way, the airflow can be positively directed toward fixing belt 61 to the portion for which temperature reduction is desired.

In the meantime, the range of the non-sheet-passing region is changed depending on the width of sheet S. According to the embodiment of the present invention, control section 101 changes the range where the direction of airflow is changed, depending on the width of sheet S which passes through the fixing nip. For example, when the range of the non-sheet-passing region is extended, the range where the first interval is formed is extended accordingly, and in contrast, when the range of the non-sheet-passing region is made narrow, the range where the first interval is formed is made narrow accordingly. In this way, it is possible to perform a suitable airflow direction changing control according to the width of sheet S.

Figure 11:
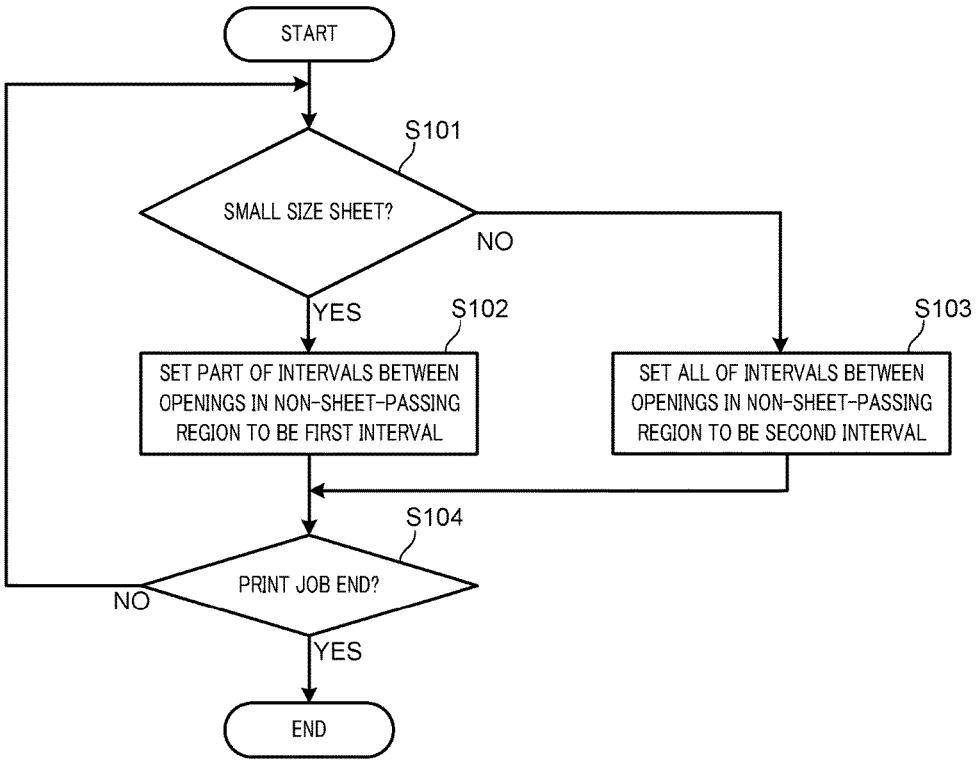
FIG. 11 is a flowchart of an exemplary operation of airflow direction changing control in the image forming apparatus.

An exemplary operation of airflow direction changing control in image forming apparatus 1 configured as described above is described. FIG. 11 is a flowchart of an exemplary operation of airflow direction changing control in image forming apparatus 1. The processing in FIG. 11 is executed when the execution instruction of a print job is input.

Note that, image forming apparatus 1 is configured to activate blowing section 210 when image forming apparatus 1 receives the execution instruction of a print job, and is configured to stop blowing section 210 after the print job is completed. In addition, all the intervals between openings in the non-sheet-passing region can be set to be the second interval at the start of the print job, for example.

As illustrated in FIG. 11, control section 101 determines whether or not sheet S is a small size sheet (step S101). When the determination result indicates that sheet S is a small size sheet (step S101, YES), control section 101 sets a part of the intervals between openings in the non-sheet-passing region to be the first interval (step S102). Note that, in step S102, when the part of the intervals between openings in the non-sheet-passing region is already the first interval, control section 101 does not change the intervals between openings in the non-sheet-passing region.

In contrast, when the determination result indicates that sheet S is not a small size sheet (step S101, NO), control section 101 sets all the intervals between openings in the non-sheet-passing region to be the second interval (step S103). Note that, in step S103, when all the intervals between openings in the non-sheet-passing region are already the second interval, control section 101 does not change the intervals between openings in the non-sheet-passing region.

After step S102 or step S103, control section 101 determines whether or not the print job has been completed (step S104). When the determination result indicates that the print job has not been completed (step S104, NO), the processing returns to step S101. In contrast, when the print job has been completed (step S104, YES), the present control is ended.

According to the embodiment of the present invention configured as described above, the temperature in the non-sheet-passing region in fixing section 60 is cooled by utilizing the airflow from separating section 200. Therefore, it is not necessary to provide a cooling fan separately, and thus, a temperature rise in the non-sheet-passing region in fixing section 60 can be prevented without image forming apparatus 1 being made oversize.

In addition, in the embodiment of the present invention, an interval between two first openings 221A are extended, so that it is possible for the airflow to easily turn back into a region of such an interval. Thus, in comparison with a configuration in which an interval between two first openings 221A is not extended, the airflow can be directed more toward fixing belt 61, and a temperature rise in the non-sheet-passing region of fixing belt 61 can be prevented more effectively.

Note that, although the airflow paths in communication with openings 221 of duct portion 220 are closed in order for the airflow not to flow out of openings 221 in the above-mentioned embodiment, the present invention is not limited to this embodiment. For example, openings 221 of duct portion 220 may be closed directly. Openings facing toward fixing belt 61 may be formed separately in the tip end of duct portion 220, and such openings may be configured to open. In addition, the path of the airflow flowing out of duct portion 220 may be configured to be changeable.

In addition, although fixing belt 61 wound around heating roller 62 and fixing roller 63 under tension is illustrated as the fixing member in the above-mentioned embodiment, the present invention is not limited to this embodiment. In a configuration in which fixing belt 61 is not provided, a fixing roller may be used as a fixing member.

In addition, the aforementioned embodiments merely describe examples of implementations for practicing the present invention, and should not be construed as limiting the technical scope of the present invention. That is, the present invention can be embodied in various forms without departing from the spirit, scope, or principal features of the present invention.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming apparatus comprising:

a rotatable fixer that forms a fixing nip between the rotatable fixer and a pressurizer;

a blower that generates airflow toward the fixing nip, the airflow being used for separating a sheet from the rotatable fixer; and a hardware processor that performs a control of the blower so that airflow amounts of the blower toward the fixing nip are different in an axial direction of the rotatable fixer and the airflow in a direction of a rotation of the rotatable fixer is increased in a non-sheet-passing region of the rotatable fixer, wherein the blower includes a duct including a plurality of openings aligned in a width direction of the sheet, the plurality of openings include a plurality of airflow openings through which the airflow flows out, the duct includes a shutter that opens and closes at least one airflow opening of the plurality of airflow openings for the airflow toward the non-sheet-passing region, and the hardware processor controls the shutter to make a first interval larger than a second interval, the first interval being defined between airflow openings adjacent to the airflow opening that is closed by the shutter in the non-sheet-passing region among the plurality of airflow openings, the second interval being defined between airflow openings adjacent to each other in a sheet-passing region among the plurality of airflow openings.

2. The image forming apparatus according to claim 1, wherein:

the hardware processor closes the shutter such that the airflow in the direction of the rotation of the rotatable fixer is increased in the non-sheet-passing region.

3. The image forming apparatus according to claim 2, wherein:

the hardware processor changes, depending on a width of the sheet passing through the fixing nip, a range within which the airflow in the direction of the rotation of the rotatable fixer is increased.

4. The image forming apparatus according to claim 1, wherein:

a portion of the rotatable fixer having a maximum temperature is included in a range of a portion corresponding to the first interval.

5. The image forming apparatus according to claim 1, wherein:

the plurality of openings are aligned at the tip end of the duct equidistantly in the width direction of the sheet, and the hardware processor controls the shutter such that the airflow in the direction of the rotation of the rotatable fixer is increased in the non-sheet-passing region.

6. The image forming apparatus according to claim 5, wherein:

the duct includes a pair of ribs defining the airflow path in communication with the at least one opening, wherein the pair of ribs is provided to each of the plurality of openings, and the shutter is configured to be capable of opening and closing an entrance of the airflow path.

7. The image forming apparatus according to claim 1, wherein:

the rotatable fixer is a fixing belt wound around a plurality of rollers under tension.

8. The image forming apparatus according to claim 1, wherein:

the rotatable fixer is a fixing roller.

* * * * *